US011056045B2

(12) United States Patent
Baumheinrich

(10) Patent No.: US 11,056,045 B2
(45) Date of Patent: Jul. 6, 2021

(54) ARRANGEMENT FOR OPERATING RADIATION EMITTING DEVICES, METHOD OF MANUFACTURING THE ARRANGEMENT AND COMPENSATION STRUCTURE

(71) Applicant: OSRAM Opto Semiconductors GmbH, Regensburg (DE)

(72) Inventor: Thorsten Frank Baumheinrich, Altdorf (DE)

(73) Assignee: OSRAM OLED GmbH, Regensburg (DE)

( * ) Notice: Subject to any disclaimer, the term of this patent is extended or adjusted under 35 U.S.C. 154(b) by 0 days.

(21) Appl. No.: 16/487,623

(22) PCT Filed: Mar. 7, 2018

(86) PCT No.: PCT/EP2018/055647
§ 371 (c)(1),
(2) Date: Aug. 21, 2019

(87) PCT Pub. No.: WO2018/162579
PCT Pub. Date: Sep. 13, 2018

(65) Prior Publication Data

US 2020/0066204 A1 Feb. 27, 2020

(30) Foreign Application Priority Data

Mar. 8, 2017 (DE) ..... 10 2017 104 908.8

(51) Int. Cl.
*G09G 3/32* (2016.01)

(52) U.S. Cl.
CPC ..... *G09G 3/32* (2013.01); *G09G 2300/0408* (2013.01); *G09G 2300/0852* (2013.01)

(58) Field of Classification Search
CPC ... G09G 2300/0408; G09G 2300/0852; G09G 3/22; G09G 3/32; H05B 45/44; H05B 47/16
See application file for complete search history.

(56) References Cited

U.S. PATENT DOCUMENTS

| | | | |
|---|---|---|---|
| 4,952,949 | A | 8/1990 | Uebbing |
| 2006/0118700 | A1 | 6/2006 | Chaussy et al. |
| 2008/0218095 | A1 | 9/2008 | Erhardt |
| 2008/0309594 | A1 | 12/2008 | Mas et al. |

(Continued)

FOREIGN PATENT DOCUMENTS

| | | | |
|---|---|---|---|
| CN | 102791063 | A | 11/2012 |
| WO | 2008/019487 | A1 | 2/2008 |

(Continued)

*Primary Examiner* — Insa Sadio
(74) *Attorney, Agent, or Firm* — DLA Piper LLP (US)

(57) ABSTRACT

An arrangement for operating radiation emitting devices includes a plurality of radiation emitting devices each having a first capacitance, a driver circuit that supplies the devices with electrical energy, and a compensation structure having a variable second capacitance corresponding to each device and means for adjusting the respective second capacitance, the compensation structure being connected to the device such that a total capacitance assigned to a device and dependent on the first capacitance can be adjusted by the second capacitance.

14 Claims, 3 Drawing Sheets

(56) References Cited

U.S. PATENT DOCUMENTS

| | | | | |
|---|---|---|---|---|
| 2009/0284519 | A1* | 11/2009 | Kim | G09G 3/3233<br>345/213 |
| 2017/0372658 | A1* | 12/2017 | Tamura | G09G 3/3275 |

FOREIGN PATENT DOCUMENTS

| | | | |
|---|---|---|---|
| WO | 2009/108391 | A1 | 9/2009 |
| WO | 2011/085927 | A2 | 7/2011 |
| WO | 2016/128716 | A1 | 8/2016 |

* cited by examiner

ARRANGEMENT FOR OPERATING RADIATION EMITTING DEVICES, METHOD OF MANUFACTURING THE ARRANGEMENT AND COMPENSATION STRUCTURE

TECHNICAL FIELD

This disclosure relates to an arrangement for operating radiation emitting devices, a corresponding manufacturing process for the arrangement, and a compensation structure for such an arrangement.

BACKGROUND

Radiation emitting devices such as LEDs can have parasitic capacitances due to production, which differ greatly, for example, from lot to lot or even within a lot. This can influence the time response of the individual LEDs as well as the driving behavior of corresponding drivers so, that especially with larger arrangements of differently colored LEDs, adjustments such as white balance or color deviations are aggravated, and artifacts occur with fast contrast changes.

To avoid this problem, LEDs can be sorted and installed according to capacitance (so-called "binning"). Alternatively, the driver power or the drive rate can be adjusted (so-called "refresh rates"). However, a contrast shift or slow drive rates must be accepted.

It could therefore be helpful to provide an arrangement for the operation of radiation emitting devices, a corresponding manufacturing process for the arrangement, and a compensation structure for such an arrangement that enables unimpaired operation of the devices and does not require complex sorting procedures.

SUMMARY

I provide an arrangement for operating radiation emitting devices including a plurality of radiation emitting devices each having a first capacitance, a driver circuit that supplies the devices with electrical energy, and a compensation structure having a variable second capacitance corresponding to each device and means for adjusting the respective second capacitance, the compensation structure being connected to the device such that a total capacitance assigned to a device and dependent on the first capacitance can be adjusted by the second capacitance.

I also provide a method of fabricating the arrangement for operating radiation emitting devices including a plurality of radiation emitting devices each having a first capacitance, a driver circuit that supplies the devices with electrical energy, and a compensation structure having a variable second capacitance corresponding to each device and means for adjusting the respective second capacitance, the compensation structure being connected to the device such that a total capacitance assigned to a device and dependent on the first capacitance can be adjusted by the second capacitance, including a) providing a plurality of radiation emitting devices, each having a first capacitance, b) measuring the first capacitance of each device, c) providing a compensation structure that, corresponding to each device, has a variable second capacitance and means for adjusting the respective second capacitance, and d) controlling the compensation structure to adjust the respective second capacitance depending on the respective measured first capacitance such that at least for some of the devices or for each of the devices, a deviation of a total capacitance assigned to the respective device from a setpoint value is reduced.

I further provide a compensation structure including a plurality of compensation elements each having a variable capacitance, and means for adjusting the respective capacitance, a communication interface that receives a control signal that sets the capacitances, and an input and an output per compensation element that couples the respective capacitance with an external circuit.

REFERENCE SIGN LIST

Figure 1:
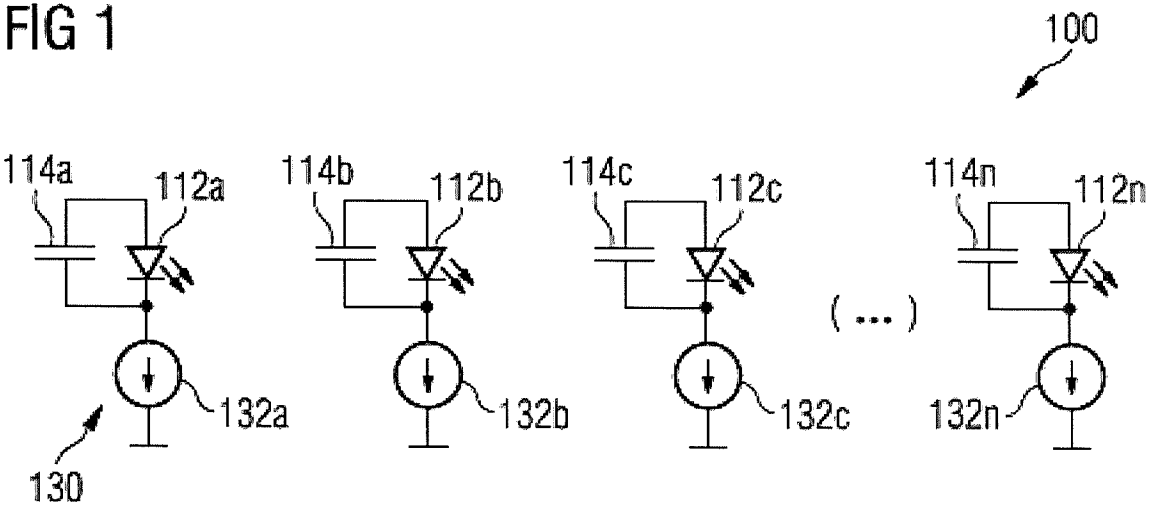
FIG. 1 schematically shows an arrangement for operating radiation emitting devices.

100, 200 Arrangement
212,
112*a* . . . 112*n*,
212*a* . . . 212*n* light-emitting device
214,
114*a* . . . 114*n*,
214*c* . . . 214*n* first capacitance
230,
130, 230 driver circuit
232,
132*a* . . . 132*n*,
232*a* . . . 232*n* current source
220 compensation structure
222,
222*a* . . . 222*n* compensation element
222-1 . . . 222-5 capacitor
222-1-1,
222-1-2 electrodes
224
224*a* . . . 224*n* second capacitance
226-1 . . . 226-5
226-1' . . . 226-4' switch
240 ground
228 via

DETAILED DESCRIPTION

I provide an arrangement for operating radiation emitting devices comprising a plurality of radiation emitting devices. The devices are, for example, light-emitting diodes (LEDs). The devices can emit light of different colors such as red (R) LED, blue (B) LED, green (G) LED or white (W) LED.

The devices can, for example, be arranged in rows or columns (as a so-called "1D array") or matrix-like (as a so-called "2D array"). In particular, several devices emitting radiation in different colors can be combined to form units, for example, as RGB element or as RGBW element. The arrangement is designed as an example for use in a display device such as an active matrix display or a passive matrix display. The combined units can then, for example, form individual pixels of the display device.

The devices each have a first capacitance. The first capacitances can in particular be parasitic capacitances of the devices. The first capacitance, for example, can vary greatly from device to device due to the manufacturing process.

The arrangement may comprise a driver circuit that supplies the individual devices with electrical energy. The driver circuit, for example, is an integrated circuit electrically coupled to the radiation emitting devices. The driver circuit comprises at least one current source and/or at least one voltage source. In particular, the driver circuit controls radiation emitting operation of the individual devices.

The arrangement may comprise a compensation structure having a variable second capacitance corresponding to each device and means for adjusting the respective second capacitance. The compensation structure connects to the devices such that a total capacitance assigned to a device and dependent on the first capacitance can be adjusted by the second capacitance.

"Corresponding to each device" is not to be understood as a restriction that the arrangement exclusively comprises devices with a corresponding variable second capacitance. In other words, the arrangement may also be constructed as a subassembly of a device comprising further devices not associated with a corresponding variable capacitance.

In particular, the compensation structure may be a compensation structure described below.

The variable second capacitance is the respective capacitance of the balancing structure that can be changed during operation of the arrangement or before commissioning but after physical completion of the arrangement. For example, the arrangement in this context includes a communication interface to receive a control signal to set the respective capacitance.

The total capacitance assigned to a particular device is the respective capacitance of the arrangement that influences the radiation emitting operation of the particular device. This includes, in particular, the capacitance of installed capacitors coupled to the respective device as well as parasitic capacitances. The total capacitance assigned to the respective device can also be referred to as the total capacitance applied to the device.

The arrangement may comprise a plurality of radiation emitting devices each having a first capacitance, a driver circuit that supplies the individual devices with electrical energy, and a compensation structure corresponding to each device each having a variable second capacitance and means that adjust the respective second capacitance. The compensation structure connects to the devices such that a total capacitance associated with a device and dependent on the first capacitance can be adjusted by the second capacitance.

In an advantageous way, this makes it possible to adjust the total capacitance assigned to a particular device. Advantageously, installation of the majority of radiation emitting devices sorted by their capacitance may be dispensed. Instead, a tolerance range can be selected that is particularly high with regard to the respective first capacitance of the devices so that the amount of scrapped devices to be installed in an arrangement can be kept to a minimum. Adjustment can be made both for a capacitance inherent in the device and capacitive effects resulting from the wiring of the device.

By matching the total capacitance assigned to a particular device, it is also possible to match an impedance applied to the driver circuit for each device. Advantageously, it is possible to dispense with an adjustment of the driver power so that a simple white balance can be achieved. In addition, there is no need to reduce the drive rate. The aforementioned measures can only be regarded as optional. Because the adaptation of the driver structures, which is usually associated with more complex dynamic and temperature adaptation, is no longer necessary, simpler driver structures can be used.

The compensation structure may connect to the devices such that the respective first capacitance and the respective second capacitance add up to a respective total capacitance at the devices.

The total capacitance of at least some of the devices can be adjusted such that a deviation of the total capacitance from a given target value is reduced. Preferably, the total capacitance of each device is adjustable in such a way.

The compensation structure may have a compensation element corresponding to each device with the respective variable second capacitance as well as means to set the respective second capacitance. The compensation element connects in parallel with the corresponding device.

By connecting the respective compensation element in parallel with the respective device, the total capacitance assigned to the respective device results from the sum of the first capacitance of the respective device and the variable second capacitance of the respective compensation element. In this way, the first capacitance of each device can be easily balanced by parallel operation.

The respective compensation element is preferably designed such that a value range of the variable, second capacitance covers an expected value range of the first capacitance of the respective device. In other words, the respective compensation element compensates a first capacitance of a respective device that lies within a predetermined tolerance range for a total capacitance with respect to the respective device by the respective variable second capacitance, the variable second capacitance designed in particular such that a predefined value of the total capacitance can be achieved by all devices with a first capacitance within the predetermined tolerance range. For example, the value range of the variable, second capacitance in this context has the same lower limit as the tolerance range and a value twice as high as the upper limit of the tolerance range. The tolerance range corresponds, for example, to the expected value range of the first capacitance. The expected value range of the first capacitance is 0 nF to 1000 nF, for example.

The compensation element, for example, comprises a digitally adjustable variable capacitor. Such a capacitor can be adapted to any radiation emitting device, especially LED. The compensation element is especially designed to adjust the variable second capacitance depending on a control signal. The compensation element is preferably set up to hold a second capacitance set in this way for an operating state of the arrangement in which no control signal is received or present.

The driver circuit may have an output corresponding to each device to supply the respective device with a predetermined current and/or voltage. The compensation element connects in parallel with the corresponding output of the driver circuit.

The output of the driver circuit can also be referred to as the driver channel. The driver circuit in particular supplies the respective output with electrical energy separately from other outputs of the driver circuit so that a radiation emitting operation of the devices can be individually controlled. The output can also be regarded as an individual current or voltage source for each device. With such direct control with the driver, each current driver output has an adjustable, configurable load capacity.

In particular, the respective compensation element, the respective device and the respective output form a parallel circuit.

The parasitic capacitance can be individually adjusted in each radiation emitting device, in particular in each individual LED, for example, in LED pixel arrays or linear one-dimensional arrangements. The circuits are parallel to each LED. This allows an adjustment of the switching times (e.g., for on/off or first contrast/second contrast). By harmonizing the entire parasitic capacitances that, for example, consist of the sum of the LED capacitance, the supply lines and the switchable capacitance, no further measures are required in the controlling current drivers such as dynamically adapted driver currents.

The majority of radiation emitting devices may form a unit with the compensation structure. In this integration concept, several devices, each providing a partial functionality of the unit, are integrated in such a unit. Examples of a module are stacked chips also designated as "die stacking," several LED chips mounted on a driver chip or several LED chips on a wafer. The devices can be arranged on top of each other or next to each other, for example, a driver chip next to an LED chip. The latter can also be referred to as "Side by Side."

It is possible to fabricate different configurations comprising the same driver chip mounted with different LED chip types so that one configuration has red, green and blue LEDs (RGB elements) and another configuration has red, green, blue and white LEDs (RGBW elements) and another configuration has several LED chips of the same type. Thus, the large number of driver channels on the driver chip can be used for different chip types.

Advantageously, this allows for the use of the majority of radiation emitting devices without having to provide additional measures for the operation of the devices. For example, the unit can form a self-contained system that can be installed without adaptation. In particular, the arrangement can be installed without the aforementioned adaptation of the driver circuit.

The driver circuit may form a unit with the compensation structure.

I also provide a process of manufacturing the arrangement. In the process (a) a plurality of radiation emitting devices is provided, each device having a first capacitance;

b) the respective first capacitance of the devices is measured;

c) a compensation structure is provided, corresponding to each device each having a variable second capacitance and means for adjusting the respective second capacitance; and d) the compensation structure is triggered to adjust the respective second capacitance as a function of the respective measured first capacitance such that at least for some of the devices, preferably for each of the devices, a deviation of a total capacitance assigned to the respective device from a setpoint value is reduced.

For example, the plurality of radiation emitting devices provided in step a) may be measured individually in step b). Alternatively, the devices measured in step b) can already be arranged in a compound, e.g., matrix-like, and at least partially measured in parallel.

The given value can depend exemplarily on a maximum value of the first capacitance of a device of the arrangement. The compensation structure can be controlled by an external control signal.

Control of the compensation structure can include, for example, switching on or off of sub-capacitors assigned to a respective compensation element. As an example, switching on or off is carried out in binary staggered form: Several groups of sub-capacitors of the same capacitance or sub-capacitors of different capacitances can be assigned to the respective compensation element, whereby the capacitance of the groups or the different sub-capacitors is staggered in the form of basic capacitance times $\{2^0, 2^1, 2^2, 2^3, \ldots\}$. The respective balancing element is preferably designed such that a variable, second capacitance adjustable deviates by a maximum of 5% from a value to be set.

The compensation structure may be driven such that the respective total capacitance assigned to the devices has a same predetermined value or a substantially same predetermined value for each device.

It is assumed that a value of the respective total capacitance assigned to a device essentially corresponds to the same predefined value if it deviates from it by less than 5%. The specified value is, in particular, the target value.

I further provide a compensation structure. The compensation structure comprises a number of compensation elements, each of which has a variable capacitance and means of adjusting the respective capacitance. In addition, the compensation structure includes a communication interface that receives a control signal to adjust the respective capacitance, as well as one input and one output per compensation element to couple the respective capacitance to an external circuit.

The compensation elements are, for example, integrated on an integrated circuit. In particular, the balancing structure is arranged to selectively provide a configurable capacitance at the respective input and output of the balancing elements. The balancing structure is particularly suitable for use in the first aspect arrangement. All characteristics discussed above therefore also apply to the compensation elements and vice versa.

Each of the compensation elements may comprise at least one first switch and at least one capacitor with a first and a second electrode. For each balancing element, the respective first electrode of the at least one capacitor is coupled to the at least one first switch. In addition, for each compensation element, the at least one first switch for coupling the respective capacitance of the at least one capacitor to the external circuit is designed to couple the respective at least one capacitor to the input and/or output of the respective compensation element as a function of the actuating signal.

Each of the compensation elements may comprise at least one second switch. For each compensation element, the respective second electrode of the at least one capacitor is coupled to the at least one second switch. In addition, for each compensation element, the at least one second switch to couple the respective capacitance of the at least one capacitor to the external circuit couples the respective at least one capacitor to the input and/or output of the respective compensation element as a function of the actuating signal. The at least one first switch forms a transmission gate together with the at least one second switch.

The compensation elements may be arranged in a matrix-like manner.

In particular, the compensation elements can be arranged correspondingly to the external circuit so that the input and output of the respective compensation element is arranged correspondingly to individual elements of the external circuit to be coupled to the respective compensation element.

The compensation elements may be digitally adjustable variable capacitors.

The digitally adjustable variable capacitors may each comprise a plurality of metal-insulator-metal capacitors, each having a first and second electrode mentioned above.

The metal-insulator-metal capacitors may be arranged between the at least one first and second switch, the first and second electrodes of the metal-insulator-metal capacitors each being coupled to the at least one first and second switch, respectively, by vias.

Examples are explained in more detail below on the basis of the schematic drawings.

Figure 2:
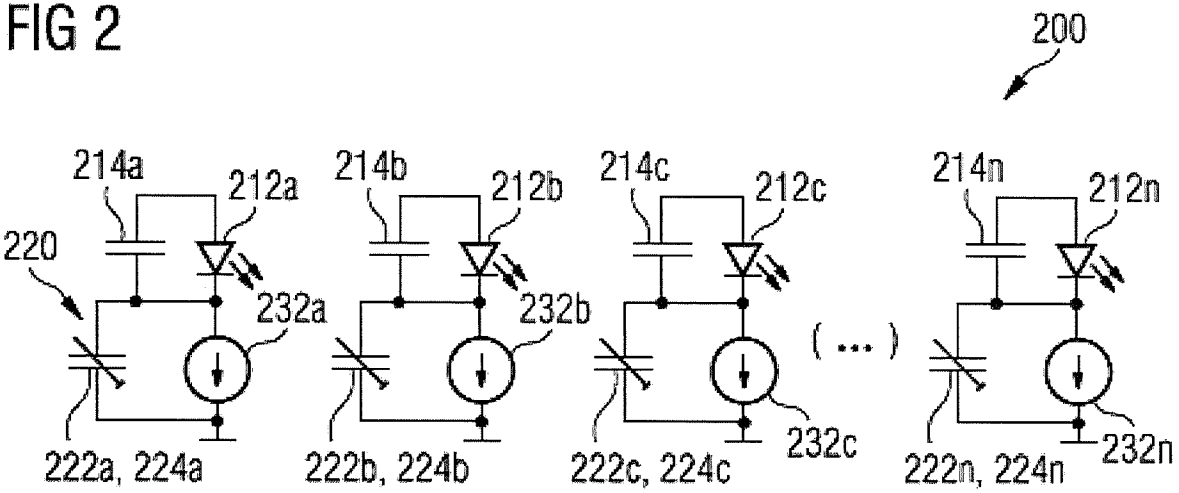
FIG. 2 schematically shows an example of a further arrangement for the operating radiation emitting devices.
Figure 3:
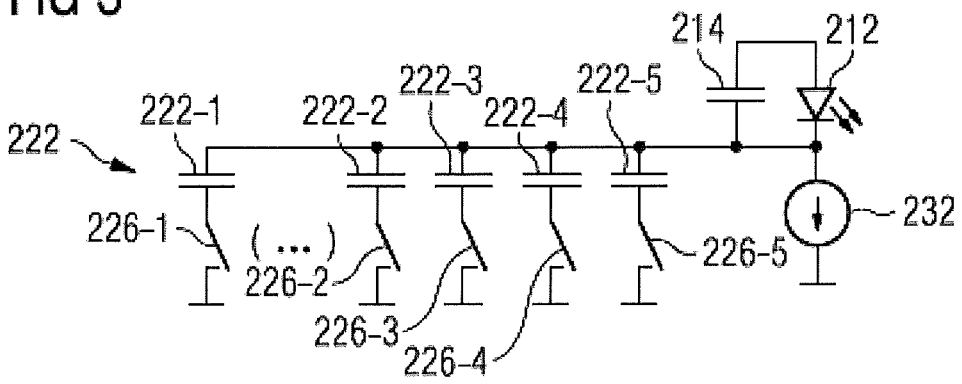
FIG. 3 schematically shows a detailed view of a compensation element of the arrangement according to FIG. 2.

Elements of the same construction or function are provided with the same reference symbols for all figures. FIGS. 1 to 3 show schematic circuit diagrams that should not be regarded as complete.

FIG. 1 shows an arrangement 100 for operating radiation emitting devices. The devices may be LEDs 112*a*, 112*b*, 112*c*, and 112*n* arranged in one or more arrays, for example, and designed for light-emitting use in an active or passive matrix display. As an example, each of the LEDs 112*a* . . . 112*n* is assigned to a color range and a pixel of the display. For example, LED 112*a* is assigned to a red color range of a pixel, LED 112*b* to a green color range of the same pixel, LED 112*c* to a blue color range of the same pixel, and LED 112*n* to a white color range of the same pixel. The LEDs 112*a* . . . 112*n*, for example, have a parasitic capacitance 114*a*, 114*b*, 114*c* or 114*n* (shown here schematically as a capacitor) that strongly scatters between the LEDs 112*a* . . . 112*n* due to production.

To avoid resulting differences in the time behavior of the individual colors of the pixel, current sources 132*a*, 132*b*, 132*c*, 132*n* coupled with the LEDs 112*a* . . . 112*n* of a driver circuit 130 are set up to adjust the power and/or the drive rate respectively.

FIG. 2 shows an example of a further arrangement 200 for operating LEDs 212*a*, 212*b*, 212*c*, 212*n* with parasitic capacitances 214*a*, 214*b*, 214*c*, or 214*n* and current sources 232*a*, 232*b*, 232*c*, or 232*n* of a driver circuit 230 that differs from arrangement 100 by an additional compensation structure 220.

The compensation structure 220 has a compensation element 222*a*, 222*b*, 222*c*, 222*n* for each LED 212*a* . . . 212*n* with a variably adjustable capacitance 224*a*, 224*b*, 224*c*, 224*n* connected in parallel to the respective parasitic capacitance 214*a* . . . 214*n*.

By connecting the capacitances 214*a* . . . 214*n* and 224*a* . . . 224*n* in parallel, a respective total capacitance, which is applied to the individual LEDs 212*a* . . . 212*n*, results from the sum of the capacitances 214*a* and 224*a*, 214*b* and 224*b*, 214*c* and 224*c*, and 214*n* and 224*n*, respectively.

As a result, by selectively adding configurable capacitances 224*a* . . . 224*n* to the individual driver channels, the total capacitance of each of the LEDs 212*a* . . . 212*n* at the respective anode/cathode can be adjusted. This eliminates the need to bin the LEDs 212*a* . . . 212*n* according to capacitance 214*a* . . . 214*n* and a wide range of manufactured LEDs 212*a* . . . 212*n* can be installed. The loads to be controlled for the individual drivers 232*a* . . . 232*n* are thus electrically adapted. With this, significantly higher refresh rates as well as an improved white balance can be achieved.

FIG. 3 shows an example of compensation element 222 of arrangement 200 according to FIG. 2, which is assigned to an LED 212. The LED 212 has a parasitic capacitance 214 and is electrically coupled to a current source 232.

The compensation element 222 comprises several capacitors 222-1, 222-2, 222-3, 222-4, 222-5 that can each connect to or be decoupled from the compensation element 222 via a switch 226-1, 226-2, 226-3, 226-4, 226-5. With open switches 226-1 . . . 226-4 and closed switch 226-5, the total capacitance present at LED 212 is the sum of the capacitances 214 and 222-5.

By suitable dimensioning of the individual capacitors 222-1 . . . 222-5 and suitable control of the individual switches 226-1 . . . 226-5, a total capacitance can be achieved for each LED 212*a* . . . 212*n*, which has essentially the same value for all LEDs. In particular, the capacitors 222-1 . . . 222-5 and the control in this context can minimize a deviation from a specified value of the total capacitance per LED 212.

Figure 4:
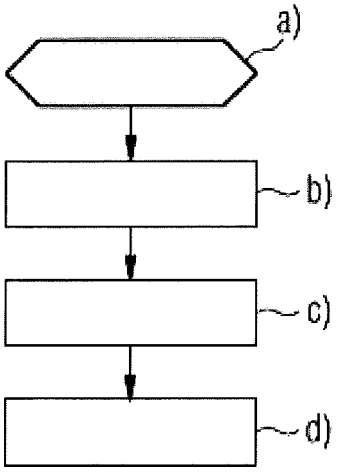
FIG. 4 is a flow chart for fabrication of the arrangement according to FIG. 2.

FIG. 4 shows an example of the fabrication of the arrangement 200 as shown in FIG. 2.

In step a) the LEDs 212*a* . . . 212*n* are provided and in step b) their respective parasitic capacitance 214*a* . . . 214*n* is measured. The distribution of the capacitances 214*a* . . . 214*n* is measured by suitable measures such that the values of the parasitic capacitances 214*a* . . . 214*n* of all individual LEDs 212*a* . . . 212*n* are known, i.e., for RGB and possibly W per pixel.

In a subsequent step c), the compensation structure 220 is provided which, corresponding to each LED 212*a* . . . 212*n*, each has the variable capacitance 224*a* . . . 224*n* set in a step d) by driving the compensation structure 220 as a function of the respective measured parasitic capacitance 214*a* . . . 214*n* such that each LED 212*a* . . . 212*n* has a substantially identical value of the total capacitance so that a distribution of the parasitic capacitance 214*a* . . . 214*n* is compensated for.

A mechanical and electrical coupling of the compensation structure 220 with the LEDs 212*a* . . . 212*n* can, for example, be carried out in step c). For example, the capacitors 226-1 . . . 226-5 of the compensation elements 222*a* . . . 222*n* are integrated in parallel to the current sources 232*a* . . . 232*n* on an integrated circuit and together with the LEDs 212*a* . . . 212*n* form a unit. The control of the compensation structure 220 can be carried out before or after step c).

For example, a control signal is applied to a communication interface (not shown) of arrangement 200, in particular the compensation structure 220 such as an SPI or I2C bus. As an example, the control signal has a binary code with a character for at least each of the switches 226-1 . . . 226-5.

Figure 5:
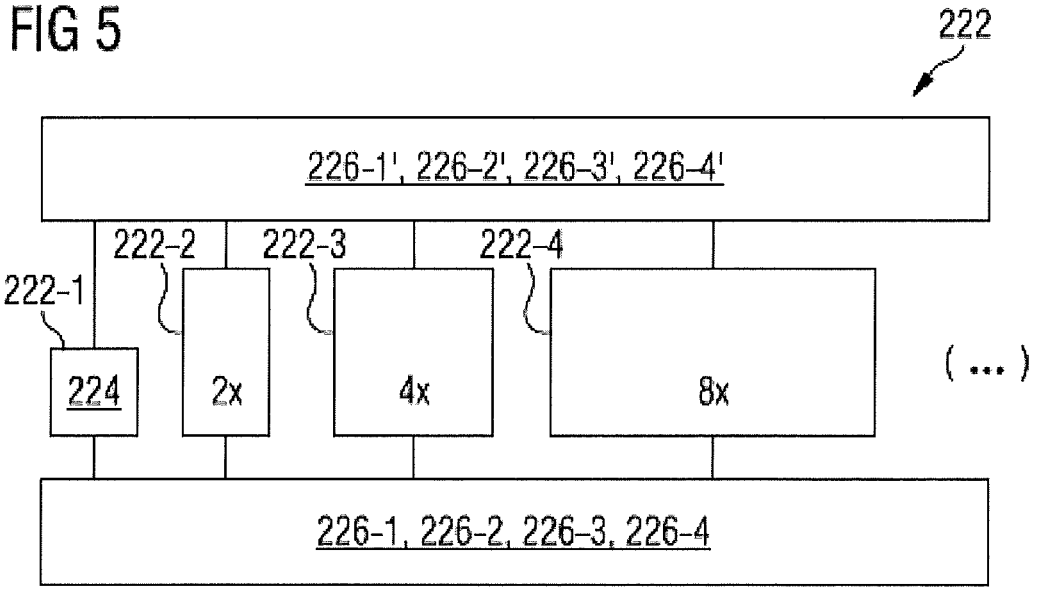
FIG. 5 schematically shows a design variation of a compensation element of the arrangement according to FIG. 2.

The capacitors 222-1 . . . 222-5 can, for example, each have the same basic capacitance 224 in a first version. FIG. 5 alternatively shows a second version of the compensation element 222 as shown in FIG. 2, where the capacitance of the capacitors 222-1 . . . 222-4 is $2^x$-times the basic capacitance 224, i.e., $2^0$* basic capacitance 224 for capacitor 222-1, $2^1$* basic capacitance 224 for capacitor 222-2, $2^2$* basic capacitance 224 for capacitor 222-3, and $2^3$* basic capacitance 224 for capacitor 222-4. The capacitors 222-1 . . . 222-4 are again coupled to a switch 226-1 . . . 226-4. In a third version of the compensation element 222 not shown in FIG. 2, it is also possible to connect several capacitors 222-1 . . . 222-5 of the same basic capacitance 224 in parallel in groups analogous to the version shown in FIG. 5 and to switch only the groups with the switches 226-1 . . . 226-4.

Advantageously, such a design enables a high-resolution and at the same time large range that can be covered by the compensation element 222.

The second configuration of the compensation element 222 shown in FIG. 5 can each have a further switch 226-1', 226-2', 226-3', 226-4' as an alternative or in addition to the switches 226-1 . . . 226-4 that can be controlled to connect a further electrode of the capacitors 222-1 . . . 226-4 to the compensation element 222 with respect to the switches 226-1 . . . 226-4 or to decouple it from the compensation element 222.

Figure 6:
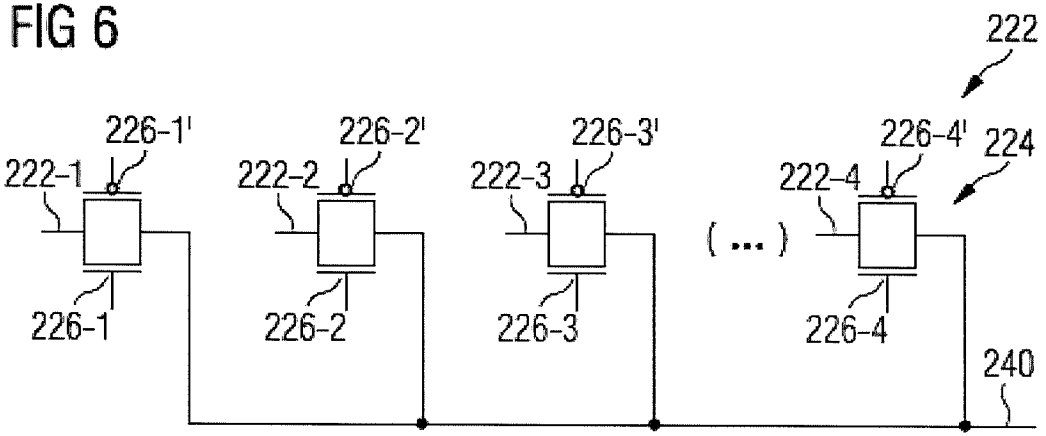
FIG. 6 schematically shows an example of a switch arrangement of a compensation element of the arrangement according to FIG. 2.

The switches 226-1 . . . 226-4, 226-1' . . . 226-4' can, for example, each have an n-channel MOSFET and/or a p-channel MOSFET. In particular, switches 226-1 and 226-1', 226-2 and 226-2', 226-3 and 226-3', and 226-4 and 226-4' may be designed as transmission gates. An exemplary switch arrangement in this context is shown in FIG. 6, where the capacitors 222-1 . . . 222-4 each connect with one electrode to a common node, e.g., with a ground.

Figure 7:
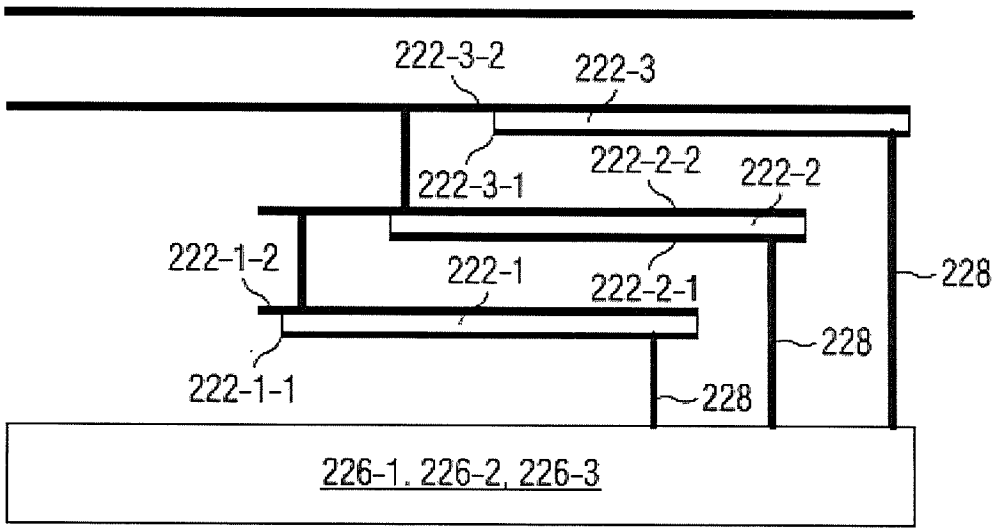
FIG. 7 schematically shows a structure of a compensation element of the arrangement according to FIG. 2.

FIG. 7 shows an exemplary structure of a compensation element 222 of the compensation structure 220 as shown in FIG. 2. The compensation element 222 has exemplary three metal-insulator-metal capacitors as capacitors 222-1, 222-2, 222-3 stacked vertically one above the other and each comprise a first electrode 222-1-1, 222-2-1, and 222-3-1, and a second electrode 222-1-2, 222-2-2, and 222-3-2, respectively. The first electrode 222-1-1 . . . 222-3-1 of the capacitors 222-1 . . . 222-3 is coupled separately to each of the switches 226-1 . . . 2226-3 by a via 228.

My arrangements, methods and structures are not limited to the examples by the description. Rather, this disclosure includes each new feature and each combination of features, which in particular includes each combination of features in the appended claims, even if the feature or combination itself is not explicitly stated in the claims or examples.

This application claims priority of DE 10 2017 104 908.8, the subject matter of which is incorporated herein by reference.

The invention claimed is:

1. An arrangement for operating radiation emitting devices comprising:

a plurality of radiation emitting devices each having a first capacitance, a driver circuit that supplies the devices with electrical energy, and a compensation structure having a variable second capacitance corresponding to each device and configured to adjust the respective second capacitance, the compensation structure being connected to the device such that a total capacitance assigned to a device and dependent on the first capacitance can be adjusted by the second capacitance.

2. The arrangement according to claim 1, wherein, at least for some of the devices or for each of the devices, the total capacitance is adjustable such that a deviation of the total capacities from a predetermined nominal value is reduced.

3. The arrangement according to claim 1, wherein the compensation structure comprises, corresponding to each device, a respective compensation element having the respective variable second capacitance and configured to adjust the respective second capacitance; and the compensation element connects in parallel with the corresponding device.

4. The arrangement according to claim 3, wherein the driver circuit has, corresponding to each device, a respective output that supplies the respective device with a predetermined current and/or with a predetermined voltage, and the compensation element connects in parallel with the corresponding output of the driver circuit.

5. The arrangement according to claim 1, wherein the plurality of radiation emitting devices forms a unit with the compensation structure.

6. A method of fabricating an arrangement with radiation emitting devices, the method comprising:

a) providing a plurality of radiation emitting devices, each having a first capacitance, b) measuring the first capacitance of each device, c) providing a compensation structure that, corresponding to each device, has a variable second capacitance and is configured to adjust the respective second capacitance, and d) controlling the compensation structure to adjust the respective second capacitance depending on the respective measured first capacitance such that at least for some of the devices or for each of the devices, a deviation of a total capacitance assigned to the respective device from a setpoint value is reduced.

7. The method according to claim 6, wherein the compensation structure is controlled such that the respective total capacitance assigned to the devices has a same predetermined value or a substantially same predetermined value for each device.

8. A compensation structure comprising:

a plurality of compensation elements each having a variable capacitance and being configured to adjust the respective capacitance, a communication interface that receives a control signal that sets the capacitances, and an input and an output per compensation element that couples the respective capacitance with an external circuit.

9. The compensation structure according to claim 8, wherein each of the compensation elements comprises at least one first switch and at least one capacitor having a first electrode and a second electrode, wherein per compensation element the respective first electrode of the at least one capacitor is coupled with the at least one first switch, and the at least one first switch that couples the respective capacitance of the at least one capacitor to the external circuit couples the respective at least one capacitor to the input and/or output of the respective compensation element as a function of the actuating signal.

10. The compensation structure according to claim 9, wherein each of the compensation elements comprises at least a second switch, wherein per compensation element the respective second electrode of the at least one capacitor is coupled to the at least one second switch, and the at least one second switch that couples the respective capacitance of the at least one capacitor to the external circuit couples the respective at least one capacitor to the input and/or output of the respective compensation element as a function of the actuating signal, wherein the at least one first switch forms a transmission gate with the at least one second switch.

11. The compensation structure according to claim 8, wherein the compensation elements are arranged in a matrix.

12. The compensation structure according to claim 8, wherein the compensation elements are digitally adjustable variable capacitors.

13. The compensation structure according to claim 12, wherein the digitally adjustable variable capacitors each comprise a plurality of metal-insulator-metal capacitors each having first and the second electrodes.

14. The compensation structure according to claim 13, wherein the metal-insulator-metal capacitors are disposed between the at least one first switch and the at least one second switch, and the first and second electrode of the metal-insulator-metal capacitors each coupled to the at least one first switch and the at least one second switch, respectively, by a via.

* * * * *